US008327872B2

(12) United States Patent
Bolduan et al.

(10) Patent No.: US 8,327,872 B2
(45) Date of Patent: Dec. 11, 2012

(54) APPARATUS FOR CONNECTING AN EXTERNAL WATER FEED LINE TO AN INTERNAL WATER LINE OF A WASHING MACHINE

(75) Inventors: Edwin Bolduan, Berlin (DE); Andre Sabalat, Berlin (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 620 days.

(21) Appl. No.: 12/528,675

(22) PCT Filed: Feb. 19, 2008

(86) PCT No.: PCT/EP2008/051987

§ 371 (c)(1),
(2), (4) Date: Feb. 19, 2008

(87) PCT Pub. No.: WO2008/104479

PCT Pub. Date: Sep. 4, 2008

(65) Prior Publication Data

US 2010/0126602 A1 May 27, 2010

(30) Foreign Application Priority Data

Feb. 27, 2007 (DE) ..... 10 2007 009 510

(51) Int. Cl.
*F16K 23/00* (2006.01)
*D06F 39/08* (2006.01)

(52) U.S. Cl. ..... 137/312; 137/460

(58) Field of Classification Search ..... 137/312, 137/400, 460
See application file for complete search history.

(56) References Cited

U.S. PATENT DOCUMENTS

| | | | | |
|---|---|---|---|---|
| 3,867,957 | A * | 2/1975 | Fehrm | 137/360 |
| 3,874,403 | A * | 4/1975 | Fischer | 137/386 |
| 5,713,387 | A * | 2/1998 | Armenia et al. | 137/312 |
| 5,931,184 | A * | 8/1999 | Armenia et al. | 137/312 |
| 6,003,536 | A * | 12/1999 | Polverari et al. | 137/15.08 |
| 6,792,776 | B2 * | 9/2004 | Bruntz et al. | 68/12.03 |
| 7,650,765 | B2 * | 1/2010 | Rizzetto | 68/17 R |

FOREIGN PATENT DOCUMENTS

| | | | |
|---|---|---|---|
| DE | 3917013 | A1 | 11/1990 |
| DE | 19537034 | C1 | 10/1996 |
| DE | 19747674 | A1 | 5/1999 |

* cited by examiner

*Primary Examiner* — John Rivell
*Assistant Examiner* — Umashankar Venkatesan
(74) *Attorney, Agent, or Firm* — James E. Howard; Andre Pallapies

(57) ABSTRACT

An apparatus is provided for connecting an external water feed line to an internal water line of a laundry care household appliance. The apparatus has a housing in which one end of an external water feed line is arranged and a safety valve for shutting off or opening a water line which is inside the housing. The housing has an opening for discharging leakage water.

17 Claims, 2 Drawing Sheets

APPARATUS FOR CONNECTING AN EXTERNAL WATER FEED LINE TO AN INTERNAL WATER LINE OF A WASHING MACHINE

BACKGROUND OF THE INVENTION

The invention relates to an apparatus for connecting an external water feed line to an internal water line of a household appliance for caring for laundry items, especially a washing machine or a washer-dryer.

It is known that washing machines have an external water feed hose via which water can be directed from a household water supply to the washing machine. It is also known that such washing machines have a safety valve to enable the water feed to be blocked or released and have an Aqua-stop functionality.

With known appliances the fitting or installation of the safety valve and the water feed system is separated and therefore demands a considerable outlay. In addition this results in different appliance connections. Last but not least the separate installation of a safety valve and of the water feed system requires a considerable amount of space.

BRIEF SUMMARY OF THE INVENTION

The object of the present invention is thus to create an apparatus with which the installation of components of a water feed arm of a household appliance can be simplified.

An inventive apparatus for connecting an external water feed line to an internal water line of a domestic appliance for caring for laundry items, especially a washing machine or a washer-dryer, comprises a housing in which one end of an external water feed line is arranged. In addition the apparatus comprises a safety valve for blocking or releasing at least one device-internal water line, at least areas of which are likewise arranged in the housing. The interface between the external water feed line and the internal water line of the household appliance is realized in the housing. In addition the housing has an opening for discharging leakage water. The inventive apparatus makes possible a compact embodiment requiring minimal space to fit, by integration of positioning within the housing of components for the external water feed line, the internal water line, the safety valve and an internal leakage water guidance system. In addition to an arrangement requiring minimal space, this embodiment also guarantees a reduction in components, since the entire apparatus can be installed as the complete unit and the safety valve and the water feed system no longer have to be installed separately on the device.

Preferably the housing comprises a first chamber in which the end of the external water feed line is arranged. Furthermore the housing preferably comprises a second chamber in which at least certain areas of the safety valve are arranged. Such a chamber system in the housing also enables a sealing system in respect of the escape of the leakage water to be generated. Leakage water entering one chamber can thus not get into the other chamber and wet components arranged there and possibly adversely affect their functionality.

Preferably the two chambers are separated by a dividing wall in which a connecting opening is embodied. The safety valve is preferably inserted into this connecting opening. In particular there is provision for the safety valve to be arranged so that it fits exactly into the connecting opening and for this connecting opening to be sealed by the insertion of a safety valve without an additional sealing element. A sufficient sealing function is thus integrated into the connection housing by such a two-chamber connection housing and a correspondingly large opening for discharging leakage water. The integration of the leakage water discharge facility also leads to explicit discharging of such water when it forms.

The precise-fit arrangement of the safety valve into the connecting opening can thus also obviate the need for an additional sealing element.

Both chambers preferably open out separately into the leakage opening and in particular the dividing wall also extends into the leakage opening. This means that the leakage water occurring in one chamber can be discharged safely and reliably without being able to get into the other chamber. Preferably the leakage opening comes out sideways from the housing. In particular the leakage opening is integrated into a lower housing part and comes out sideways from this lower housing part. In particular there is provision for the leakage opening to be a tubular connecting piece. This embodiment enables the leakage water to be discharged reliably and specifically from the housing. An additional leakage water hose is no longer required.

The formation of chambers in the housing apparatus especially prevents the leakage water from reaching the electrical connections. This can also be especially prevented in the event of the volume of the first chamber in which the end of the external water feed line is arranged not being sufficient.

Preferably the apparatus is embodied as a preinstalled module and is provided as a complete system for installation in the household appliance. Preferably the feed hose and the safety valve can thus be pre-installed and can be inserted into a two-part housing with an upper housing part and a lower housing part and this housing can be sealed. This completely preinstalled module allows the final installation to be simplified and also speeded up. In addition a reduction in costs can be achieved on the one hand by a reduction in the number of components and by the module pre-installation. This makes it possible to also make cost savings through the faster final assembly of this preinstalled module. In particular a uniform device connection of various devices can be made possible and a uniform device connection can be embodied for the Aqua-stop feed hose.

In addition to there being no need for a leakage water hose, a shortening of the feed hose length with more flexible hose routing outside the device can be achieved.

BRIEF DESCRIPTION OF THE DRAWINGS

An exemplary embodiment of the invention is explained below in greater detail with reference to schematic drawings, in which.

DETAILED DESCRIPTION OF EXEMPLARY EMBODIMENTS OF THE PRESENT INVENTION

Identical elements or elements with the same functions are provided with the same reference symbols in the figures.

Figure 1:
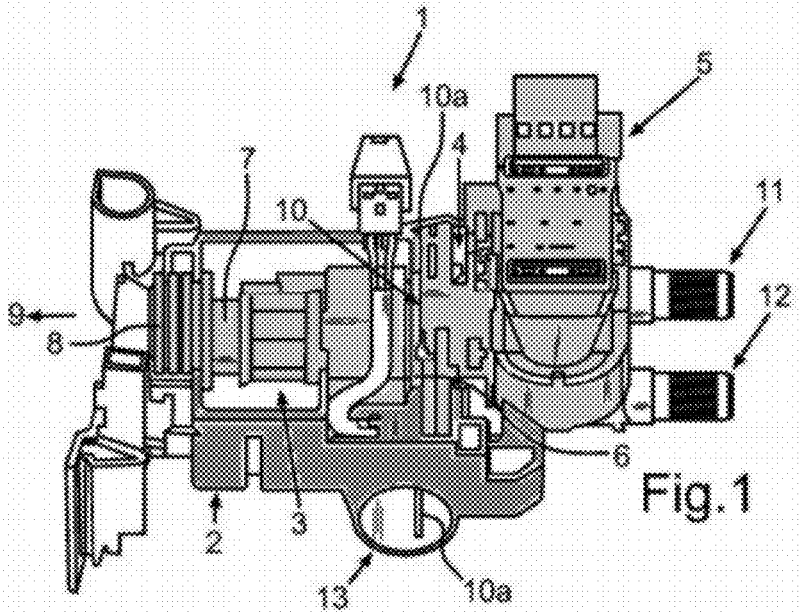
FIG. 1 shows a perspective diagram of an inventive apparatus.

FIG. 1 shows an exemplary embodiment of apparatus 1, which is embodied for connecting an external water feed line to an internal water line of a washing machine designed with an Aqua-stop functionality. The apparatus 1 comprises a housing which features a lower housing part 2. Embodied in the housing is a first chamber 3 as well as a second chamber 4. A safety valve 5 of the apparatus 1 is arranged with a valve body 6 disposed at least in some areas in the second chamber 4. The body 6 fits without any sealing element in the housing and is especially arranged in a connecting opening 10 between the chambers 3 and 4 without an additional sealing element, but sealing this connecting opening 10 however. This connecting opening 10 is embodied in a dividing wall 10*a* which separates the chambers 3 and 4.

Embodied on the valve body 6 are two connections 11 and 12 which represents two separate connections for the hoses of the internal water feed system of the washing machine.

One end of an external water feed line, which comprises a water hose 7 and a jacket hose 8, comes out into the housing of the apparatus 1. This external feed line leads to an external water source 9 which can be the household water supply.

In the lower housing part 2 there is also an opening 13 embodied for discharging leakage water. This leakage opening 13 is integrated completely into the lower housing part 2 and comes out sideways from the lower housing part 2.

This opening 13 is embodied as a tubular connecting peace and is arranged so that the two chambers 3 and 4 open out into the opening. In addition it can be seen that the dividing wall 10*a* is also embodied within this opening 13 and thus also separates the chambers 3 and 4 within this tubular connecting piece.

To prevent water escaping on the valve side and thus into the area of the second chamber 4, the leakage water which might get into this chamber is discharged via this side opening 13. Likewise for a seal failure in the water feed area and thus in the area of the first chamber 3 any leakage water getting into the chamber will be explicitly removed from the inside of a washing machine, and via the inner side of a sidewall 14 (FIG. 2) and a drainage channel embodied in the area of the floor module of the washing machine, arrives at a flotation switch not shown.

Figure 2:
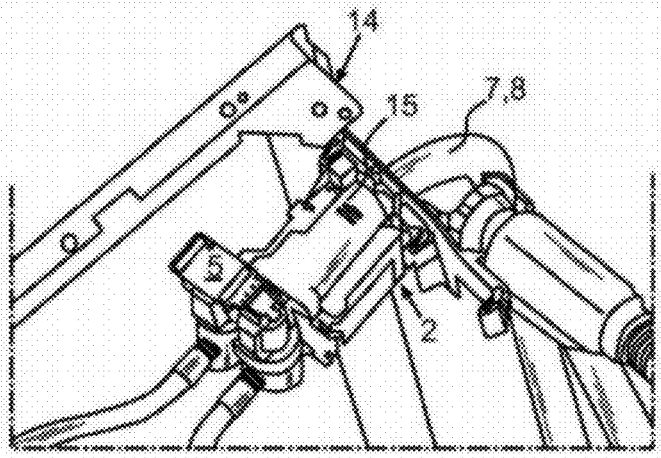
FIG. 2 shows a perspective diagram of an inventive apparatus installed in a washing machine.
Figure 3:
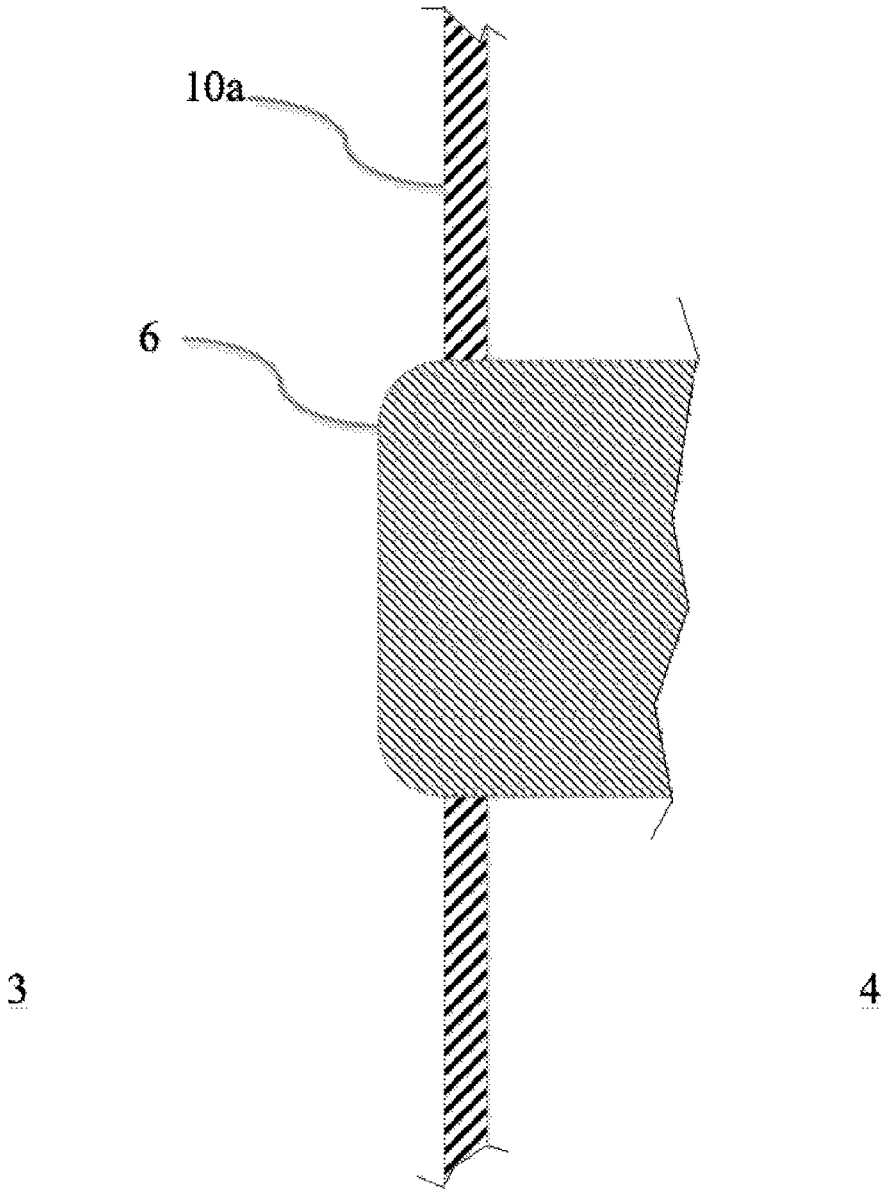
FIG. 3 shows a cross-sectional view of the valve body and dividing wall of the inventive apparatus.

With the proposed system the safety valve 5 or the valve body 6 and the water feed system are thus connected in one housing. In particular the apparatus 1 is provided as a completely preinstalled module with initially the water hose 7, the jacket hose 8 and the safety valve 5 with the valve body 6 being inserted accordingly into some areas of the housing and this housing being sealed. To this end the upper housing part 15 shown in FIG. 2 is joined to the lower housing part 2. For example a screw connection or also a latching connection or such like can be provided. The module provided and preinstalled in this way can then be subsequently finally installed in a simple and rapid manner into the household appliance.

The invention claimed is:

1. An apparatus for connecting an external water feed line to an internal water line of a laundry care domestic appliance, the apparatus comprising:

a housing, the housing having a first chamber for receiving one end of the external water feed line, a second chamber and an opening for discharging leakage water, wherein the first chamber and the second chamber open separately into the opening for discharging leakage water; and a safety valve, at least one portion of the safety valve being arranged in the second chamber of the housing and being operable to selectively block or permit a flow of water through the internal water line.

2. The apparatus as claimed in claim 1, wherein the first chamber and the second chamber are separated by a dividing wall having a connecting opening.

3. The apparatus as claimed in claim 2, wherein the safety valve is inserted into the connecting opening.

4. The apparatus as claimed in claim 2, wherein the safety valve is arranged to fit substantially exactly into the connecting opening in a manner such that the connecting opening is substantially sealed via the safety valve without a need for an additional sealing element.

5. The apparatus as claimed in claim 1, wherein the opening is configured as a tubular connecting piece.

6. The apparatus as claimed in claim 1, wherein the opening extends sideways from the housing.

7. The apparatus as claimed in claim 1, wherein the opening is integrated completely into a lower housing part.

8. The apparatus as claimed in claim 1, wherein the apparatus is configured as a preinstalled module and is provided as a complete system for installation into a household appliance.

9. An apparatus for connecting an external water feed line to an internal water line of a laundry care domestic appliance, the apparatus comprising:

a housing having a first chamber which receives the external water feed line, a second chamber, a dividing wall having a connecting opening and which separates the first chamber and the second chamber from each other, and an opening for discharging leakage water from the housing, the first chamber and the second chamber opening separately into the opening for discharging leakage water; and a valve operable to selectively block or permit a flow of water through the internal water line, the valve having a valve body arranged to fit precisely into and seal the connecting opening without a need for an additional sealing element.

10. The apparatus as claimed in claim 9, wherein the valve comprises a safety valve.

11. The apparatus as claimed in claim 9, wherein the opening is configured as a tubular connecting piece.

12. The apparatus as claimed in claim 9, wherein the opening extends sideways from the housing.

13. The apparatus as claimed in claim 9, wherein the housing comprises a lower housing part and an upper housing part.

14. The apparatus as claimed in claim 13, wherein the opening is provided at the lower housing part.

15. The apparatus as claimed in claim 9, further comprising a connection on the valve body for the internal water line.

16. The apparatus as claimed in claim 9, further comprising an external water feed line which leads to an external water source.

17. The apparatus as claimed in claim 16, wherein the external water feed line comprises a water hose and a jacket hose which comes out into the housing.

* * * * *